United States Patent [19]

Edberg

[11] Patent Number: 4,637,561

[45] Date of Patent: Jan. 20, 1987

[54] BEATER MILL HAVING AT LEAST ONE VERTICALLY OR OBLIQUELY EXTENDING CYLINDRICAL MILLING CHAMBER

[75] Inventor: Dan O. Edberg, Kolding, Denmark

[73] Assignee: A/S Ingeniorgruppen AF, Christiansfel, Denmark

[21] Appl. No.: 551,908

[22] Filed: Nov. 15, 1983

[30] Foreign Application Priority Data

Nov. 15, 1982 [DK] Denmark ..... 5069/82

[51] Int. Cl.[4] ..... B02C 13/282

[52] U.S. Cl. ..... 241/154; 241/188 R; 241/194

[58] Field of Search ..... 241/57, 154, 188 R, 241/189 R, 190, 194

[56] References Cited

U.S. PATENT DOCUMENTS

| | | | |
|---|---|---|---|
| 1,635,453 | 7/1927 | Agnew | 241/188 R X |
| 2,093,703 | 9/1937 | Blodgett | 241/154 X |
| 2,290,379 | 7/1942 | Peterson | 241/188 R X |
| 2,508,682 | 5/1950 | Miner, Jr. et al. | 241/194 |
| 2,578,822 | 12/1951 | Miner, Jr. et al. | 241/194 X |
| 2,700,511 | 1/1955 | Denovan et al. | 241/154 |
| 2,700,512 | 1/1955 | Denovan et al. | 241/154 |
| 3,214,105 | 10/1965 | Owens et al. | 241/188 R X |
| 3,329,350 | 7/1967 | Wisgerhof et al. | 241/188 R X |
| 3,987,970 | 10/1976 | Burkett | 241/154 X |
| 3,993,256 | 11/1976 | Brewer | 241/188 R X |
| 4,151,794 | 5/1979 | Burkett | 241/154 X |

FOREIGN PATENT DOCUMENTS

| | | | |
|---|---|---|---|
| 1263706 | 5/1961 | France | 241/188 R |
| 760498 | 10/1956 | United Kingdom | 241/188 R |

*Primary Examiner*—Mark Rosenbaum

*Attorney, Agent, or Firm*—Antonelli, Terry & Wands

[57] ABSTRACT

A beater mill has at least one vertically or obliquely extending cylindrical milling chamber and a rotor rotatably supported in the chamber. The axis of the rotor extends parallel to the axis of the chamber. A number of protruding beaters are supported pivotably on the rotor and an inlet opening is arranged above the rotor for the supply of goods to be milled. An outlet opening is arranged below the rotor for discharge of milled goods. The cylindrical chamber wall is impermeable, optionally air-impermeable, to goods to be milled and having been milled.

2 Claims, 1 Drawing Figure

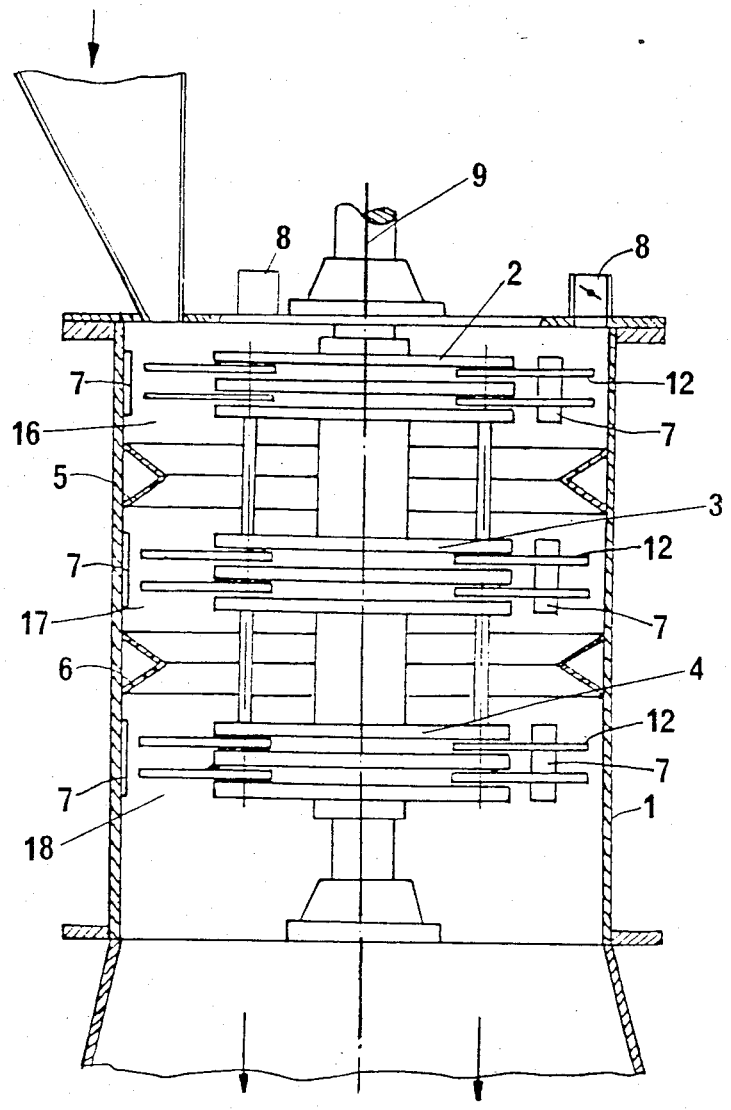
9
8
8
2
7
12
16
7
5
3
7
12
17
7
6
4
12
7
7
1
18

BEATER MILL HAVING AT LEAST ONE VERTICALLY OR OBLIQUELY EXTENDING CYLINDRICAL MILLING CHAMBER

The present invention relates to a beater mill having at least one vertically or obliquely extending cylindrical milling chamber and furthermore comprising a rotor being rotatably supported in the chamber, the axis of said rotor extending parallel to the axis of the chamber, a number of protruding beaters pivotably supported on the rotor, an inlet opening arranged above the rotor for the inlet of goods to be milled, and an outlet opening arranged below the rotor for milled goods. In such beater mills the cylindrical milling chamber wall is formed by a sieve or screen, through which a fraction of the milled goods is discharged. Said sieve is regularly clogged up and necessitates a cleaning thereof which causes an interruption of operation to the beater mill.

In the beater mill according to the invention the cylindrical chamber wall is impermeable, optionally air impermeable, to milling goods or milled goods. Thereby, the above disadvantage is eliminated, and a beater mill is provided which operates with longer beater lifetimes and lower maintenance and repair costs than prior beater mills, and which, beyond in general being well fit for pulverization of milling goods, is also well fit for milling of oily grain and feedstuff which in the traditional beater mills often will clog up the sieve. The air consumption of the mill might, besides, be reduced to 10–15% of the normal value for corresponding, prior mills. Said low air consumption, besides, causes a greater security against dust explosions.

Where one or more additional milling chambers having beater furnished rotors is/are arranged below the mentioned cylindrical milling chamber, a funnel ring may preferably be arranged between each pair of milling chambers. Such funnel ring being arranged at the inner surface of the chamber wall is formed so as to guide the milled goods from a milling chamber inside the beater periphery for the rotor of the next milling chamber for increasing the milling effect.

The milling effects in the next milling chamber is increased by each milling chamber at the inner surface of the cylindrical wall having axially extending slowing-down projections, seeing that the material, i.e. the milling goods, in the foregoing chamber having its rotation slowed down.

At least one adjustable air supply opening is arranged on top of the upper milling chamber and optionally near the inner surface of the cylindrical chamber wall. Thereby the milling goods may be brought downwards through the beater mill by means of both the gravitation and the air supplied from the openings, and the axial speed of the goods through the mill may be adjusted to be most advantageous at minimum or optimum energy consumption.

For further increasing the milling effect the rotor of the next milling chamber may rotate in a direction opposite to that of the rotor in the foregoing chamber. This milling effect is increased in the next chamber, no matter whether the rotation of the milling goods from the foregoing chamber is totally, partly or not at all obstructed by the mentioned slowing down projections.

The invention will now be described in more detail in connection with a preferred embodiment and with reference to the drawing, which shows a portion of an axial section through a vertically arranged beater mill according to the invention.

From a supply hopper at the top left side the milling goods are supplied to the beater mill, the cylindrical wall 1 thereof including three rotors 2, 3, and 4 being mutually connected and rotating in the same direction. The beater mill is divided into three sections each containing a rotor 3, and funnel rings 5 and 6 for the milling goods are positioned between the sections. The funnel rings direct the milling goods from the wall 1 radially inwardly and axially downwardly to a smaller diameter in the beater mill. Projections 7 for slowing down the rotation of the milling goods in the direction of rotation of the rotors are arranged on the wall 1 opposite to each rotor. Said slowing down projections might be omitted in case the rotor 3 rotates in a direction opposite that of the rotors 2, 4. Where the projections are omitted, the smooth surface of the cylindrical wall inherently offers lower resistance or friction to the movement of the grain during milling and therefore there is less formation of heat.

On top of the beater mill a plurality of adjustable supply openings or nozzles 8 for adjusting the intake or blowing air to the beater mill are arranged in a circle. The intake air through the nozzles 8 may be adjusted for increasing or decreasing the material speed through the mill and thereby obtaining an optimum energy consumption. Here the axis of the rotors 2, 3, and 4 merge with the axis 9 of the cylindrical chamber wall 1, but in case the common axis of the rotors is oblique, the chamber wall axis 1 may be located higher than the common axis of the rotors parallel thereto. Each rotor is provided with a plurality of beaters 12 forming the wear parts of the beater mill, said beaters being pivotably connected to respective rotors. Each rotor 2, 3, 4 with beaters 12 is arranged in its respective section or milling chamber 16, 17, and 18 in the beater mill.

The slowing down projections 7 may be rectangular or curved portions in a number of two to four in each milling chamber 16, 17, 18. In the drawing they are shown having their longitudinal direction along the generatrices of the chamber wall 1. The mill is here shown with three sections, but this number of sections may be reduced to one or may be increased. Preferably, the mill is working at variable speed and is well fit for computer-controlled operation. The variable peripheral speed renders the mill well fit for a homogeneous milling, seeing that the peripheral speed of the beaters may be adapted to the nature of the milling goods. In case of heterogeneous materials the peripheral speed should be adjusted to the goods being most difficult to mill. This applies no matter whether the rotors run in the same direction or rotate alternately in opposite directions.

In case the milling goods are not oily or otherwise sticky, the chamber wall 1 in one or more lowermost milling chambers 17, 18 may be substituted by a sieve or a perforated plate while the chamber wall of the uppermost chamber(s) is/are a solid plate.

I claim:

1. A beater mill for milling materials such as oily grain, comprising at least one upwardly extending milling chamber having a cylindrical inner surface of an impermeable chamber wall, a rotor rotatably supported in the chamber, the axis of said rotor extending parallel to the axis of the chamber, a number of protruding beaters supported pivotably on the rotor, an inlet opening arranged above the rotor for supply of goods to be milled, and an outlet opening as well as an outlet which extends from said outlet opening away from said milling chamber, said outlet opening and said outlet both having a diameter which is at least the same diameter as the largest diameter of the inner surface of the milling chamber arranged below the rotor for discharge of milled goods, wherein the cylindrical inner surface of the milling chamber wall is smooth and free of obstructional means that may form a resistance against the flow of milling foods along the cylindrical inner surface thereby reducing the generation of heat from friction during milling, and wherein the maximum distance of the beaters from the axis of the rotor is less than the distance from said axis to the inner surface of the milling chamber.

2. A beater mill for milling grain, comprising at least one upwardly extending milling chamber having a cylindrical inner surface of an impermeable chamber wall, a rotor rotatably supported in the chamber, the axis of said rotor extending parallel to the axis of the chamber, a number of protruding beaters supported pivotably on the rotor, an inlet opening arranged above the rotor for supply of goods to be milled, and an outlet opening of at least the same diameter as the inner surface of the milling chamber arranged below the rotor for discharge of milled goods, wherein the cylindrical inner surface of the milling chamber wall is smooth and free of obstructional means that may form a resistance against the flow of milling goods along the cylindrical inner surface, wherein the maximum distance of the beaters from the axis of the rotor is less than the distance from said axis to the inner surface of the milling chamber, wherein at least two milling chambers are arranged coaxially with respect to one another in said beater mill, and wherein the rotor of one of said milling chambers rotates in the direction opposite to that of the rotor in the other chamber.

* * * * *